United States Patent [19]

Murase et al.

[11] Patent Number: 4,948,687

[45] Date of Patent: Aug. 14, 1990

[54] MULTI-LAYERED SQUARYLIUM-BASED POSITIVE CHARGE ELECTROPHOTOGRAPHIC PHOTORECEPTOR

[75] Inventors: Masanori Murase; Ichiro Takegawa; Makoto Takemoto; Yasuo Sakaguchi, all of Kanagawa, Japan

[73] Assignee: Fuji Xerox Co., Ltd., Tokyo, Japan

[21] Appl. No.: 292,044

[22] Filed: Dec. 30, 1988

[30] Foreign Application Priority Data

Jan. 8, 1988 [JP] Japan ..... 63-001360

[51] Int. Cl.[5] ..... G03G 5/06

[52] U.S. Cl. ..... 430/58; 430/66; 430/73

[58] Field of Search ..... 430/73, 74, 58, 59, 430/66

[56] References Cited

U.S. PATENT DOCUMENTS

| | | | |
|---|---|---|---|
| 4,353,971 | 10/1982 | Chang et al. | 430/58 |
| 4,409,309 | 10/1983 | Oka | 430/65 |
| 4,521,621 | 6/1985 | Yanus et al. | 564/307 |
| 4,523,035 | 6/1985 | Yanus | 564/307 |
| 4,524,218 | 6/1985 | Baranyi et al. | 564/307 |
| 4,700,001 | 10/1987 | Tanaka et al. | 430/73 |
| 4,752,650 | 6/1988 | Tanaka et al. | 564/307 |

*Primary Examiner*—John L. Goodrow

*Attorney, Agent, or Firm*—Finnegan, Henderson, Farabow, Garrett, and Dunner

[57] ABSTRACT

An electrophotographic photoreceptor for use in positive charging electrophotographic machines is disclosed, comprising an electrically conductive substrate having thereon a charge transporting layer, a charge generating layer, and a low resistance surface protective layer, in that order, wherein a squarylium acid derivative having an asymmetrical structure represented by the formula (I):

(I)

wherein $R_1$ and $R_2$ may be the same or different and represent a —$CH_3$ group or a group (wherein Y represents a halogen atom), and $X_1$ and $X_2$ may be the same or different and represent a hydrogen atom, an —OH group or a halogen atom, is dispersed in said charge generating layer.

11 Claims, 1 Drawing Sheet

MULTI-LAYERED SQUARYLIUM-BASED POSITIVE CHARGE ELECTROPHOTOGRAPHIC PHOTORECEPTOR

FIELD OF THE INVENTION

The present invention relates to a photoreceptor used in positive charging electrophotographic machines.

BACKGROUND OF THE INVENTION

Most laminated organic electrophotographic photoreceptors currently produced have a charge generating layer laminated beneath a charge transporting layer. Since electrophotographic photoreceptors of this type use positive hole transport systems, they require negative charging. Accordingly, various defects such as nonuniformity in the charging of the corotoron and high ozone concentration formation are caused on the electrophotographic photoreceptor by the negative charge. Previous attempts to resolve these defects were aimed at constructing a photoreceptor wherein a charge generating layer was laminated above a charge transporting layer and used with a positive charge while a low resistance surface protective layer was laminated as the top layer in order to improve mechanical strength and quality, as described in, e.g., U.S. Pat. No. 4,409,309.

Electrophotographic photoreceptors of this type of construction, however, have various shortcomings and defects. For example, they fail to hold sufficient charge and thus produce unsatisfactory low contrast levels and low potentials. When they can hold a sufficient charge, however, light decay is insufficient, residual potential is too high, charge potential and residual potential fluctuate due to variations in temperature and humidity, charge potential and residual potential fluctuate under repeated use, and the decrease in sensitivity is greater than before the surface protective layer was added.

The use of symmetric squarylium acid derivatives as materials for the charge generating layer has been proposed for use in electrophotographic photoreceptors to avoid such shortcomings and defects, e.g., in U.S. Pat. Nos. 4,353,971, 4,521,621, 4,523,035, 4,524,218 and 4,752,650. However, squarylium acid derivatives comprising symmetric structures have certain defects and drawbacks. For example, they account for poor dispersibility, nonuniform coating, and great straggling of pigment particle distribution in the coating solution. Additionally, in regard to electrical properties, there are problems associated with cycle stability in sensitivity, residual potential and surface potential.

SUMMARY OF THE INVENTION

An object of the present invention is to overcome the problems and disadvantages of the prior art by providing a novel electrophotographic photoreceptor that is used with positive charging without the aforementioned defects and drawbacks.

A further object of the present invention is to provide an electrophotographic photoreceptor that prevents decreased charge potential and high residual potential, minimizes the effects of temperature and humidity, and restricts decreased sensitivity, while stabilizing the residual potential and charge potential during repeated use.

Another object of the present invention is to provide an electrophotographic photoreceptor that includes a squarylium acid derivative having an asymmetric construction shown by the following formula (I):

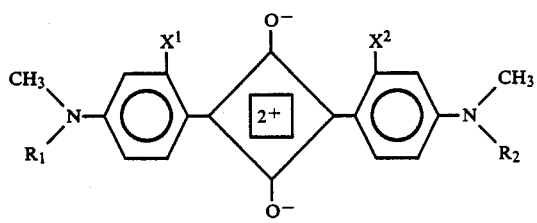

(I)

wherein $R_1$ and $R_2$ are respectively a —$CH_3$ group or a

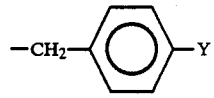

group (wherein Y is a halogen atom), $X_1$ and $X_2$ are respectively hydrogen atoms, —OH groups or halogen atoms.

Additional objects and advantages of the present invention will be set forth, in part, in the detailed description which follows and, in part, will be obvious from the description or may be learned by and attained by means of the instrumentalities and combination of steps particularly pointed out in the appending claims.

To achieve the foregoing and other objects and in accordance with the purpose of the present invention, as embodied and broadly described herein, the electrophotographic photoreceptor of the present invention which uses positive charging comprises a conductive substrate having thereon a transporting layer, a charge generating layer, and a low resistance protective layer, in that order, wherein the charge generating layer comprises a squarylium acid derivative having an asymmetrical structure represented by the following formula (I):

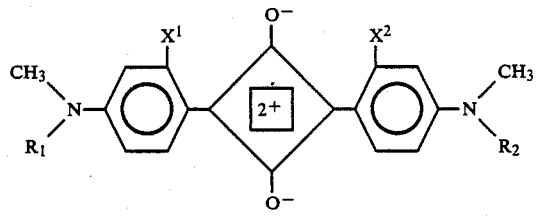

(I)

wherein $R_1$ and $R_2$ are respectively a —$CH_3$ group or a

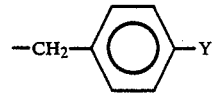

(where Y is a halogen atom), $X_1$ and $X_2$ are respectively hydrogen atoms, —OH groups or halogen atoms, is dispersed in the charge generating layer.

The electrophotographic photoreceptor according to the present invention which uses positive charging has successive laminations of a charge transporting layer, a charge generating layer and a low resistance surface protective layer, respectively, on an electrically conductive substrate, with the squarylium acid derivative having an asymmetrical configuration as shown in formula (I) being dispersed throughout the charge generating layer.

While the squarylium acid derivative having an asymmetrical construction as shown by formula (I) used in the present invention is markedly inferior in chargeability during negative charging, it is remarkably superior in chargeability during positive charging. Additionally, as a layer component of a photoreceptor, it exhibits superior electrical properties, i.e., cycle stability of residual potential and surface potential, when incorporated in laminated type construction.

The accompanying drawings, which are incorporated in and constitute a part of this specification, illustrate the preferred embodiments of the present invention and, together with the description, serve to explain the principles of the invention.

DETAILED DESCRIPTION OF THE INVENTION

Reference will now be made, in detail, to the preferred embodiments of the present invention, examples of which are illustrated in the accompanying drawings. Whenever possible, the same reference numbers will be used throughout the drawings to refer to the same or like parts.

Figure 1:
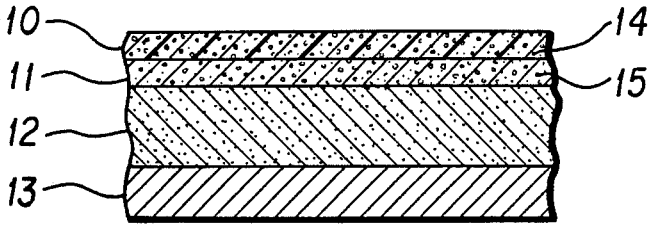
FIG. 1 is a sectional view of an electrophotographic photoreceptor of the present invention.
Figure 2:
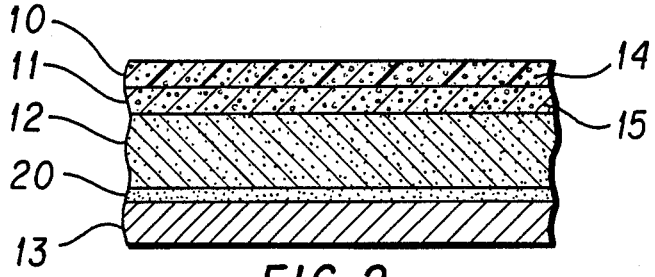
FIG. 2 is a sectional view of another electrophotographic photoreceptor of the present invention.
Figure 3:
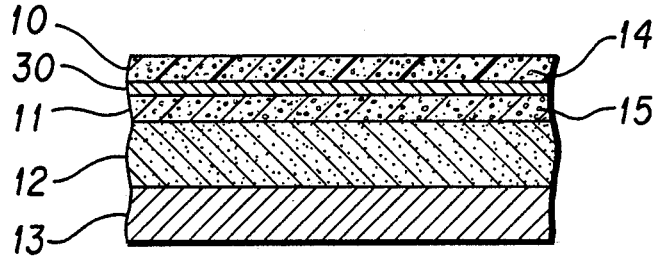
FIG. 3 is a sectional view of another electrophotographic photoreceptor of the present invention.
Figure 4:
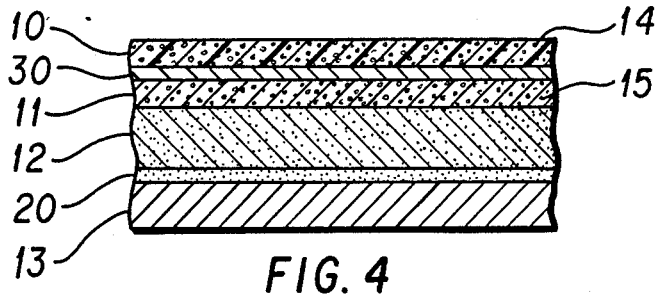
FIG. 4 is a sectional view of another electrophotographic photoreceptor of the present invention.

Referring to FIG. 1 and in accordance with the present invention, it may be seen that a low resistance surface protective layer 10 is provided on top of a charge generating layer 11 that is provided on top of a charge transporting layer 12. The charge transporting layer 12 is provided on top of an electrically conductive substrate 13, with electrically conductive metal oxide 14 being dispersed in the low resistance surface protective layer 10 and charge generating material 15 being dispersed in the charge generating layer 11. In FIG. 2, adhesive layer 20 is provided between the electrically conductive substrate 13 and the charge transporting layer 12. In FIG. 3, charge injection preventing layer 30 is provided between the charge generating layer 11 and the low resistance surface protective layer 10. In FIG. 4, adhesive layer 20 is provided between the electrically conductive substrate 13 and the charge transporting layer 12, and a charge injection preventing layer 30 is provided between the charge generating layer 11 and the low resistance surface protective layer 10.

The electrically conductive substrate 13 may be in the form of drums or sheets which may be made of metals such as aluminum, copper, iron, zinc or nickel, or may be made from other materials such as paper, plastic or glass in which case the surfaces are treated to impart conductivity by such methods as metal deposition using aluminum, copper, gold, silver, platinum, palladium, titanium, nickel-chrome, stainless steel or copper-indium; deposition of conductive metal compounds such as indium oxide, tin oxide, molybdenum oxide and tungsten oxide; lamination of metal foils; or coating of coating solutions in which carbon black or conductive metal compound powders such as indium oxide, antimony oxide-tin oxide, tin oxide, titanium oxide, molybdenum oxide and tungsten oxide are dispersed in a binder resin.

The charge transporting layer 12 includes charge transporting material. Examples of the charge transporting material include pyrene; N-ethylcarbazole; N-isopropylcarbazole; 2,5-bis(p-diethylaminophenyl)-1,3,4-oxadiazole; 1-phenyl-3-(p-diethylaminostyryl)-5-(p-diethylaminophenyl) pyrazoline; 1-[pyridyl(2)]-3-(p-diethylaminostyryl)-5-(p-diethylaminophenyl) pyrazoline; 1-[quinolyl(2)]-3-(p-diethylaminostyryl)-5-(p-diethylaminophenyl) pyrazoline; triphenylamine; N,N-diphenyl- N,N'-bis(3-methylphenyl)-(1,1'-biphenyl)-4,4'-diamine; 4-diethylaminobenzaldehyde-1,1'-diphenylhydrazone; 4,4'-benzylidenebis(N,N'-diethyl-m-toluidine; poly-N-vinylcarbazole; halogenated poly-N-vinylcarbazole; polyvinyl pyrene; polyvinyl anthracene; polyvinyl acridine; poly-9-vinyl phenyl anthracene; pyrene-formaldehyde resin; and ethylcarbazole-formaldehyde resin. Among these, N,N'-diphenyl-N,N'-bis(3-methylphenyl)-(1,1'-biphenyl)-4,4'-diamine and triphenylamine are preferred. These charge transporting materials may be used alone or in combinations of two types or more. It is to be noted that the present invention is not to be limited by the charge transporting materials identified above as the specific charge transporting materials have been identified only as exemplary charge transporting materials.

Binder resins that may be used in the charge transporting layer 12 may be general use resins such as acrylic resin, methacrylic resin, polystyrene, polyester, polyallylate, polysulfone and polycarbonate, and positive hole transporting polymers such as poly-N-vinylcarbazole. Among these, polycarbonate resins are preferred, and further bisphenol A type polycarbonate PC(A) and bisphenol Z type polycarbonate PC(Z) are particularly preferred. The provision of an adhesive layer 20 between the electrically conductive substrate 13 and the charge transporting layer 12 is optional and depends on the needs of the particular physical configuration chosen for the photoreceptor.

Squarylium acid derivatives shown by the above formula (I) are used as the charge generating material 15 in the charge generating layer 11 of the present invention. Specific examples of these squarylium acid derivatives are given below. It is to be noted, however, that the present invention is not limited to the construction so given.

(I-1)

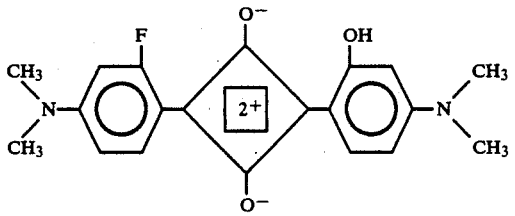

(I-2)

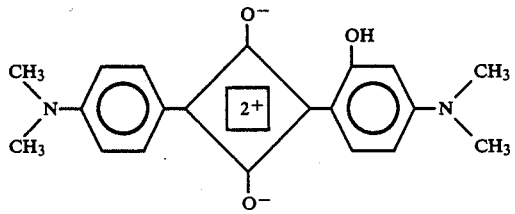

(I-3)

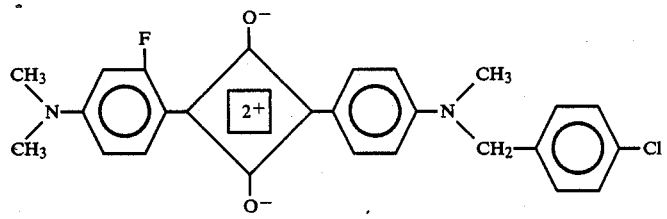

(I-4)

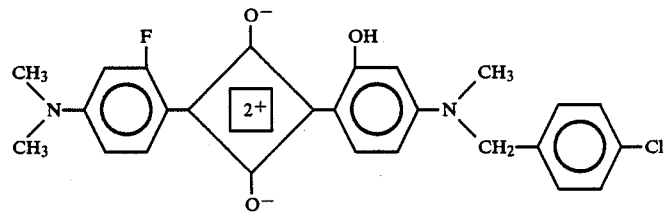

(I-5)

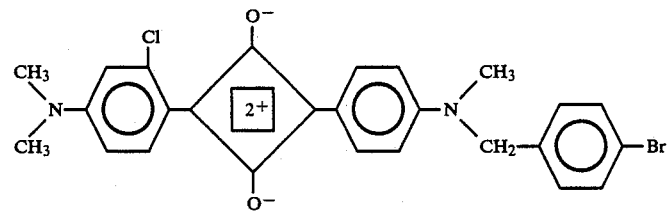

(I-6)

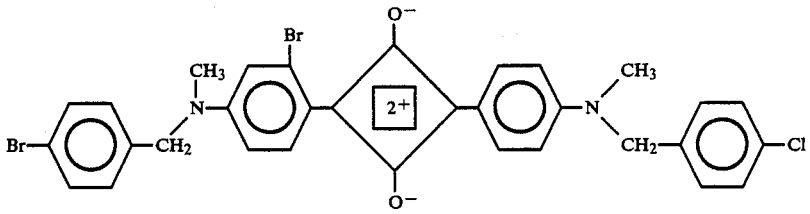

Among these, formulae (I-1) and (I-4) are preferred.

In the present invention, the above squarylium acid derivatives are dispersed in a binder resin, for example, in an amount of from 5 wt % to 90 wt %, and preferably from 20 wt % to 50 wt %. Suitable particle diameters for the squarylium acid derivatives may be 0.02 to 3 μm, and preferably 0.05 to 1 μm. Binder resins which can be used in the charge generating layer include polyvinyl butyral, vinyl polyacetate, polyester, polycarbonate, a phenoxy resin, an acrylic resin, vinylchloride-vinylacetate-maleic acid ternary copolymer, polyacrylamide, polyamide, a polyvinyl pyridine resin, casein, polyvinyl alcohol and poly-N-vinyl carbazole. Among these resins, polyvinyl butyral and polyester are preferred.

The low resistance surface protective layer 10 in the present invention comprises a fine powder of conductive metal oxide 14 dispersed in an insulating resin. The maximum average diameter of the conductive metal oxide is generally 0.3 μm or less, and preferably 0.1 μm or less. The conductive metal oxide desirably has a white, gray or bluish white color. The electrical resistance of the conductive metal oxide is generally from $1\times10^{9}$ Ω.cm or less, and preferably from $1\times10^{-1}$ to $1\times10^{7}$ Ω.cm. Examples of suitable conductive metal oxide include molybdenum oxide, tungsten oxide, antimony oxide, tin oxide, titanium oxide, indium oxide and tin oxide solid solutions with antimony or antimony oxide, or mixtures of these, and products with these metal oxides mixed as single particles, and products coated with these metal oxides. Among these conductive metal oxides, solid solutions of tin oxide and antimony or antimony oxide, and tin oxide itself are capable of lowering electrical resistance, and since they make it possible to make the protective layer substantially transparent, they are preferred. (See JP-A-57-30847 and JP-A-57-128344.) (The term "JP-A" as used herein refers to a "published unexamined Japanese patent application".)

It is preferred that the construction of the low resistance surface protective layer 10 is such that the electrical resistance is in the range of from $1\times10^9$ to $1\times10^{14}$ Ω.cm, and preferably from $1\times10^{10}$ to $1\times10^{13}$ Ω.cm. When the electrical resistance is more than $1\times10^{14}$ Ω.cm, residual potential rises and fogging is caused on the produced copies. When the electrical resistance is less than $1\times10^9$ Ω.cm, picture image becomes unfocused, and the strength of the picture image is decreased.

The protective layer must be constructed so as to substantially prevent passage of the light used in image exposure. When the particle diameter of the conductive metal oxide used is too large, the protective layer becomes nontransparent, resulting in reduced sensitivity and the lowering of picture density. Regarding particle diameter, it should be less than the wavelength of the light used for picture exposure, i.e., from 0.42 to 0.8 μm, desirably less than or equal to half the wavelength of the light used, preferably 0.3 μm or less, and more preferably 0.1 μm or less.

With respect to the insulating resin, transparent resins which exhibit stable electrical resistance under varying conditions in temperature and humidity are preferred. Examples of insulating resins suitable for use in the present invention include condensation resins such as polyamide, polyurethane, polyester, an epoxy resin, polyketone and polycarbonate, and vinyl polymer such as polyvinyl ketone, polystyrene and polyacrylamide, among which polyurethane is preferred because of its coating strength and chemical stability. The fine particles of the conductive metal oxide is preferably dispersed in an amount of from 20 wt % to 60 wt % of the insulating resin. When the amount is less than 20 wt %, the charge resistance goes $1\times10^{14}$ Ω.cm or more, and when the amount is more than 60 wt %, the coating strength of the protective layer is decreased markedly. Consequently, the wt % content of conductive metal oxide in the resin dispersion is preferably in the range from 30 wt % to 50 wt %.

A charge injection preventing layer 30 may be furnished between the low resistance surface protective layer 10 and the charge generating layer 11. The forming material for this supplemental layer 30 may be a coupling agent such as a silane coupling agent or a titanium coupling agent; an organic metal compound such as an organic zirconium compound or an organic titanium compound; or a general use resin such as polyester or polyvinyl butyral.

Regarding the thickness of each layer, the charge transporting layer may generally be 5 to 40 μm, and preferably 8 to 30 μm. The charge generating layer may generally be 5 μm or less, and preferably 0.1 to 3 μm, and the low resistance surface protective layer may generally be 0.5 to 20 μm, and preferably 1 to 10 μm. Further, an adhesive layer comprising polyester resins and Adhesive 49000 (manufactured by Du Pont Ltd.) and having a thickness of from 0.01 to 1.0 μm and/or a charge injection preventing layer comprising an organic zirconium compound such as zirconium butoxide and a silane coupling agent and having a thickness of from 0.01 to 1.0 μm may be provided.

EXAMPLES

The present invention will be further explained by way of the following examples. As used in the following examples, the term "part" or "parts" refers to "part(s) by weight".

EXAMPLE 1

An electrophotographic photoreceptor was prepared by laminating, using successive spray coating, a charge transporting layer, charge generating layer and surface protective layer, respectively, onto a PET (polyethylene terephthalate) substrate with aluminum deposited thereon. The composition of each layer was as follows:

Charge Transporting Layer (thickness: 20 μm)

| Charge Transporting Layer (thickness: 20 μm) | |
|---|---|
| Polycarbonate Resin (PANRAITO, made by Teijin, Ltd.) | 50 parts |
| 1-Phenyl-3-(p-diethylaminostyryl)-5-(p-diethylaminophenyl)pyrazoline | 50 parts |

Charge Generating Layer (thickness: 1 μm)

| Charge Generating Layer (thickness: 1 μm) | |
|---|---|
| Squarylium Acid Derivative [illustrated Compound (I-1)] | 40 parts |
| Polyester Resin (ADOHESSHIBU 4900, made by Du Pont) | 60 parts |

Low Resistance Surface Protective Layer (thickness: 2 μm)

| Low Resistance Surface Protective Layer (thickness: 2 μm) | |
|---|---|
| Tin Oxide Powder | 40 parts |
| Polyurethane Resin | 60 parts |

This electrophotographic photoreceptor, using a commercial electrostatic copy test paper apparatus ("Electrostatic Paper Analyzer SP-428", manufactured by Kawaguchi Denki K.K.), was given a positive charge by application of a +7 kv corona discharge. The surface potential V DDP was measured after discharge in darkness for 1 second. The photoreceptor was irradiated with a 5 lux tungsten light for 3 seconds, and the amount of light (E ½) needed to bring the V DDP to half value in the period was obtained. The photoreceptor was then irradiated with a 200 lux light for 0.5 second, then further decayed, and the residual potential (RP) was obtained. These procedures were repeated continuously 1,000 times, and cycle stability was shown by taking the V DDP and RP differences between cycle 1 and cycle 1,000 as Δ V DDP (C) and Δ RP (C). The above procedures were repeated in an environmental condition of 10° C. and 20% RH (relative humidity), and in an environmental condition of 30° C. and 80%

RH, to show environmental stability by taking the differences of V DDP and RP in cycle 1 as Δ V DDP (E) and Δ RP (E).

The values obtained in the present example are shown below.

| | |
|---|---|
| V DDP | 1,100 V |
| E ½ | 0.6 lux · second |
| RP | 65 V |
| Δ V DDP (C) | 65 V |
| Δ RP (C) | 30 V |
| Δ V DDP (E) | 50 V |
| Δ RP (E) | 30 V |

The above results show that the photoreceptor of Example 1 made in accordance with the present invention exhibits sufficient chargeability, high sensitivity, and superior cycle stability and environmental stability.

COMPARATIVE EXAMPLES 1 TO 4

Electrophotographic photoreceptors were prepared in the same manner as in Example 1, except that squarylium acid derivatives comprising the symmetric constructions shown below in structural formulae (A) to (D) were used instead of the asymmetric squarylium acid derivative used in the charge generating layer in Example 1.

(A)

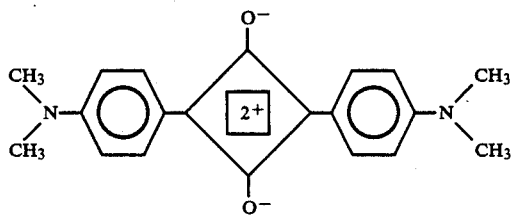

(B)

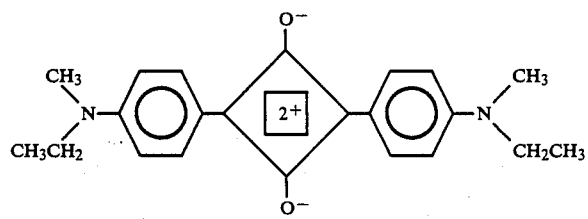

(C)

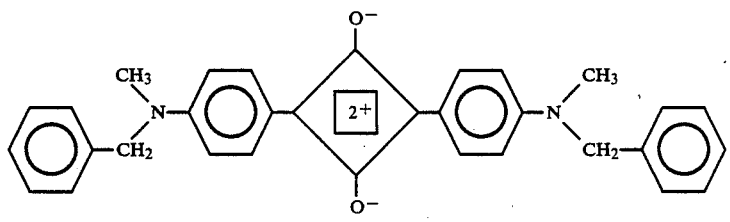

(D)

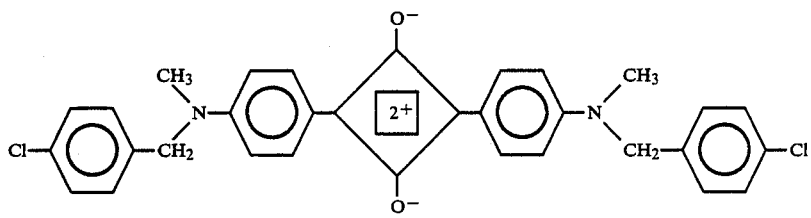

After conductive the same procedures in the same manner as in Example 1, it was found that sensitivity was low, and there were problems in the cycle stability of the surface potential. The results are shown in Table 1.

TABLE 1

| Comparative Example | Structural Formula | V DDP (V) | E ½ (lux · sec) | RP (V) | Δ V DDP (C) (V) | Δ RP (C) (V) | Δ V DDP (E) (V) | Δ RP (E) (V) |
|---|---|---|---|---|---|---|---|---|
| 1 | (A) | 1,000 | 2.3 | 80 | 140 | 30 | 110 | 30 |
| 2 | (B) | 1,020 | 2.8 | 100 | 120 | 30 | 90 | 30 |
| 3 | (C) | 900 | 3.2 | 90 | 130 | 30 | 100 | 30 |
| 4 | (D) | 800 | 3.5 | 100 | 110 | 30 | 110 | 30 |

EXAMPLE 2

An electrophotographic photoreceptor was prepared in the same manner as in Example 1, except that the low resistance surface protective layer in Example 1 was changed to a tin oxide-antimony oxide solid solution/-polyurethane resin in a 35/65 parts mix ratio. After conducting the same procedures in the same manner as in Example 1, the photoreceptor exhibited the same stabilized properties as in Example 1.

| | |
|---|---|
| V DDP | 990 V |
| E ½ | 0.8 lux · second |
| RP | 65 V |
| Δ V DDP (C) | 65 V |
| Δ RP (C) | 30 V |
| Δ V DDP (E) | 60 V |
| Δ RP (E) | 30 V |

The above results show that the photoreceptor of Example 2 made in accordance with the present invention exhibits sufficient chargeability, high sensitivity, and superior cycle stability and environmental stability.

TABLE 2-continued

| Example | |
|---|---|
| 6 | Polycarbonate resin |
| | Charge Transporting Layer (parts/parts) |
| 3 | Polycarbonate resin/4,4'-benzylidenebis(N,N'-diethyl-m-toluidine) = 60/40 |
| 4 | Polycarbonate resin/4,4'-diphenyl-N,N'-bis(3-methylphenyl)-[1,1'-biphenyl]-4,4'-diamine = 60/40 |
| 5 | Polycarbonate resin/4,4'-benzylidenebis(N,N'-diethyl-m-toluidine) = 50/50 |
| 6 | Polyester resin/2,5-bis(p-diethylaminophenyl)-1,3,4-oxadiazole = 50/50 |

TABLE 3

| Example | V DDP (V) | E ½ (lux · sec) | RP (V) | Δ V DDP (C) (V) | Δ RP (C) (V) | Δ V DDP (E) (V) | Δ RP (E) (V) |
|---|---|---|---|---|---|---|---|
| 3 | 1,100 | 0.7 | 75 | 75 | 30 | 65 | 30 |
| 4 | 1,020 | 0.8 | 75 | 80 | 30 | 60 | 30 |
| 5 | 1,040 | 0.9 | 80 | 85 | 35 | 55 | 30 |
| 6 | 1,000 | 0.7 | 70 | 70 | 30 | 60 | 30 |

COMPARATIVE EXAMPLE 5

An electrophotographic photoreceptor was prepared in the same manner as in Example 1, except that a layer of methyl cellulose having a thickness of 1 μm was furnished instead of low resistance surface protective layer furnished in Example 1. After conducting the same procedures in the same manner as in Example 1, it exhibited the following characteristics.

| | |
|---|---|
| V DDP | 900 V |
| E ½ | 1.2 lux · second |
| RP | 90 V |
| Δ V DDP (C) | 130 V |
| Δ RP (C) | 50 V |
| Δ V DDP (E) | 240 V |
| Δ RP (E) | 70 V |

The above results show that there are problems, particularly in environmental stability.

EXAMPLES 3 TO 6

Electrophotographic photoreceptors were prepared in the same manner as in Example 1, except that the charge transporting layer was varied to the combinations shown below (shown in Table 2). After conducting the same procedures in the same manner as in Example 1, the results show that the photoreceptors of Examples 3 to 6 made in accordance with the present invention exhibit sufficient chargeability, high sensitivity, and superior cycle stability and environmental stability. The results are shown in Table 3.

TABLE 2

| Example | |
|---|---|
| | Charge Generating Layer Binder |
| 3 | Polystyrene resin |
| 4 | Polycarbonate resin |
| 5 | Polyester resin |

EXAMPLES 7 TO 9

Electrophotographic photoreceptors were prepared in the same manner as in Example 1, except that the asymmetric structure squarylium acid derivative in Example 1 was varied as shown in Table 4 below. After conducting the same procedures in the same manner as in Example 1, the results show that photoreceptors of Examples 7 to 9 made in accordance with the present invention exhibit sufficient chargeability, high sensitivity, and superior cycle stability and environmental stability. The results are shown in Table 4.

TABLE 4

| Example | Structural Formula* | V DDP (V) | E ½ (lux · sec) | RP (V) | Δ V DDP (C) (V) | Δ RP (C) (V) | Δ V DDP (E) (V) | Δ RP (E) (V) |
|---|---|---|---|---|---|---|---|---|
| 7 | (I-2) | 1,020 | 0.9 | 70 | 85 | 30 | 65 | 30 |
| 8 | (I-3) | 980 | 0.8 | 75 | 80 | 30 | 60 | 30 |
| 9 | (I-4) | 1,080 | 0.8 | 80 | 80 | 30 | 60 | 30 |

*Asymmetric structure squarylium acid derivative of the present invention

The electrophotographic photoreceptor made in accordance with the present invention comprises a charge transporting layer, a charge generating layer and a low resistance surface protective layer respectively laminated onto a conductive substrate, and contains a squarylium acid derivative having an asymmetric structure shown by the above formula (I) as a charge generating material in the charge generating layer, and owing to this particular arrangement, the photoreceptor of the present invention has superior chargeability, high degree of sensitivity, high cycle stability and environmental stability.

It will be apparent to those skilled in the art that various modifications and variations can be made in the particular embodiments of the present invention without departing from the scope or spirit of the invention. Thus, it is intended that the present invention cover the modifications and variations of this invention provided they come within the scope of the appended claims and their equivalents.

We claim:

1. An electrophotographic photoreceptor for use in positive charging electrophotographic machines comprising an electrically conductive substrate having thereon a charge transporting layer, a charge generating layer, and a low resistance surface protective layer, in that order, wherein a squarylium acid derivative having an asymmetrical structure represented by the formula (I):

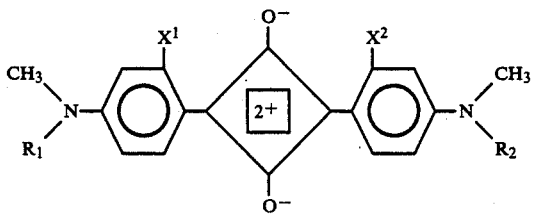

(I)

wherein $R_1$ and $R_2$ may be the same or different and represent a $—CH_3$ group or a

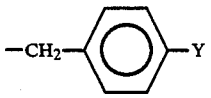

group (wherein Y represents a halogen atom), $X_1$ and $X_2$ may be the same or different and represent a hydrogen atom, an —OH group or a halogen atom, and wherein at least one of said $X_1$ and $X_2$ is an —OH group; is dispersed in said charge generating layer.

2. The electrophotographic photoreceptor as claimed in claim 1, wherein said low resistance surface protective layer is a layer comprising fine particles of conductive metal oxides dispersed in an insulating resin binder, which have an electric resistance of $1\times10^9$ Ω.cm or less and an average particle diameter of 0.3 μm or less.

3. The electrophotographic photoreceptor as claimed in claim 1, wherein the squarylium acid derivative is dispersed in a resin binder of said charge generating layer in an amount of from 5 to 90 wt %.

4. The electrophotographic photoreceptor as claimed in claim 1, wherein the squarylium acid derivative has an average particle diameter between 0.02 and 3 μm.

5. The electrophotographic photoreceptor as claimed in claim 3, wherein the resin binder of said charge generating layer is polyvinyl butyral or polyester.

6. The electrophotographic photoreceptor as claimed in claim 2, wherein the fine particles of conductive metal oxides have an electric resistance of from $1\times10^{-1}$ to $1\times10^7$ Ω.cm and an average particle diameter of 0.1 μm or less.

7. The electrophotographic photoreceptor as claimed in claim 2, wherein the fine particles of conductive metal oxides comprise a solid solution of tin oxide and antimony or antimony oxide.

8. The electrophotographic photoreceptor as claimed in claim 1, wherein said low resistance surface protective layer has an electric resistance of from $1\times10^9$ to $1\times10^{14}$ Ω.cm.

9. The electrophotographic photoreceptor as claimed in claim 2, wherein the fine particles of conductive metal oxides are dispersed in an insulating resin binder of said low resistance surface protective layer in an amount of from 20 to 60 wt %.

10. The electrophotographic photoreceptor as claimed in claim 2, wherein the insulating resin binder is polyurethane.

11. The electrophotographic photoreceptor as claimed in claim 1, wherein said charge transporting layer, said charge generating layer and said low resistance surface protective layer have each a thickness of from 5 to 40 μm, 5 μm or less, and from 0.5 to 20 μm, respectively.

* * * * *